US005687053A

United States Patent [19]

Takase et al.

[11] Patent Number: 5,687,053

[45] Date of Patent: Nov. 11, 1997

[54] ELECTRODE IN AN ELECTRIC GATHERING APPARATUS

[75] Inventors: Masahiro Takase, Fujisawa; Takasi Ouchiyama, Ayase, both of Japan

[73] Assignee: Fuji Oozx Inc., Japan

[21] Appl. No.: 567,553

[22] Filed: Dec. 5, 1995

[51] Int. Cl.[6] ..... B21J 9/08; H05B 6/56

[52] U.S. Cl. ..... 361/225

[58] Field of Search ..... 361/225; 72/482.93, 72/482.94; 29/888.4–888.46

[56] References Cited

U.S. PATENT DOCUMENTS 3,793,873 2/1974 Iwata et al. ..... 72/318

4,263,799 4/1981 Motizuki ..... 72/318

5,054,301 10/1991 Soga et al. ..... 72/318

*Primary Examiner*—Fritz Fleming

*Attorney, Agent, or Firm*—Zarley, McKee, Thomte, Voorhees, & Sease

[57] ABSTRACT

In a conductive plate of an upper electrode of an electric gathering apparatus for manufacturing a poppet valve used in an internal combustion engine, there is formed a polygonal bore in which a drive shaft is engaged. An annular cut-away portion which is larger than the engagement bore in diameter is formed, thereby preventing a burr and increasing durability of the electrode.

2 Claims, 3 Drawing Sheets

ELECTRODE IN AN ELECTRIC GATHERING APPARATUS

BACKGROUND OF THE INVENTION

The present invention relates to a long-life electrode used in an electric gathering apparatus.

Material is molded to a rough body which is similar to a product and is subjected to mechanical processing to manufacture a poppet valve. As means for molding the rough body, for example, as shown in FIG. 3, an elongate material 1 is molded to a primary rough body 2 which has a spherical end portion by an electric gathering apparatus "A", and is subjected to hot forging by a pressing machine to form a secondary rough body 3.

The electric gathering apparatus "A" comprises an upper electrode 4, a lower electrode 5, a pusher 6 which goes up and down, for example, by hydraulic means, and a power source 7 for supplying current to the electrodes 4 and 5.

FIG. 4 illustrates a rotary electrode 4. The bottom-having cylindrical rotary electrode 4 which has different diameters is rotatably supported releasably by a pair of suspension members 8 to a stationary member 9 of the electric gathering apparatus "A" not to move vertically and laterally as shown in FIG. 3. There are provided four projections 10 at regular intervals in an upper larger-diameter portion 4*a*.

A conductive plate 11 is cylindrical, and has four vertical engagement grooves 12 on the outer circumferential surface and a hexagonal engagement bore 13 around an axis. The conductive plate 11 is engaged in the rotary electrode 4 by fitting the engagement projections 10 in the engagement grooves 12 such that the upper surfaces are in the same plane.

A hexagonal engagement plate 16 is fixed to the lower end of a drive shaft 15 of a drive member 14, such that the engagement plate 16 is detachable from the engagement bore 13. The drive shaft 15 is rotated intermittently by a motor (not shown), so that the rotary electrode 4 is simultaneously rotated.

The conductive plate 11 of the rotary electrode 4 is made of copper, and the upper inner edge of the engagement bore 13 is isolated from air, thereby involving poor radiation of heat. Further, when a workpiece is processed, it is subjected to high temperature, and gathering is repeated at a number of times, so that the edge portions are gradually deformed inwards to generate a burr 17. Therefore, for example, to replace the rotary electrode 4, it is difficult to break down each member, which often requires repair and processing.

SUMMARY OF THE INVENTION

It is an object of the present invention to provide an electrode of an electric gathering which is continuously usable for a long time without repairing.

To achieve the object, according to the present invention, there is provided an electrode in an electric gathering apparatus for supplying current to a workpiece which is held between upper and lower electrodes to press the workpiece towards the upper electrode to expand an upper end of the workpiece, the upper electrode comprising a rotary electrode on which the upper end of the workpiece is engaged, and a conductive plate which is engaged in a bottom-having bore on the rotary electrode releasably and unrotatably, the conductive plate having a polygonal engagement bore in which a drive shaft is fitted around its axis, an annular cut-away portion which is larger than the engagement bore in diameter being formed at an upper edge of the engagement bore.

According to the present invention, the cut-away portion having larger diameter is continuously formed with the engagement bore at the upper edge of the engagement bore of the conductive plate, so that a burr which is generated inwards by deformation of the upper edge of the engagement bore owing to rise in temperature during gathering does not project to outlet and inlet paths of the drive shaft. Thus, it can be continuously used for a long time.

BRIEF DESCRIPTION OF THE DRAWINGS

The features and advantages of the present invention will become more apparent from the following description of preferred embodiment with respect to appended drawings wherein.

DETAILED DESCRIPTION OF PREFERRED EMBODIMENT

Figure 1:
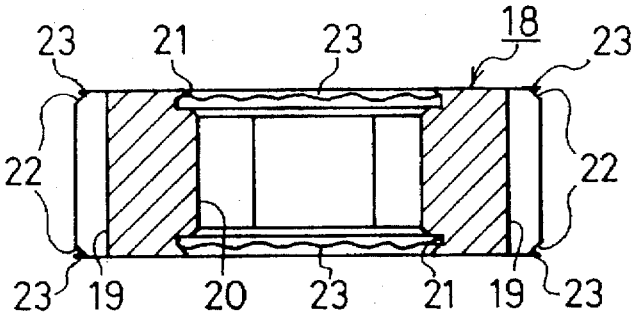
FIG. 1 is a central longitudinal sectional front view of a conductive plate which is used in an electrode of the present invention.

FIG. 1 illustrates a conductive plate 18 used in an electrode of the present invention, and the other members allotted by the same numerals are similar to the foregoing description. The detailed description thereof is omitted. On the outer circumferential surface of the conductive plate 18, there are formed engagement grooves 19 and a hexagonal engagement bore 20 around its axis similar to the above. At the upper and lower ends of the engagement bore 20, there are formed and chamfered annular cut-away portions 21 which is larger than the engagement bore 20 in diameter. At the upper and lower edges of the outer circumferential surface of the conductive plate 18, there are formed and chamfered arcuate cut-away portions 22.

Thus, even if the conductive plate 18 is heated and there is formed a burr 23 on the upper edge of the engagement bore 20 and the upper and lower edges of the outer circumferential surface, it does not project to the path of the drive member 14. Even if it is continuously used for a long time, the drive member 14 can be easily pulled out of the conductive plate 18.

Figure 2:
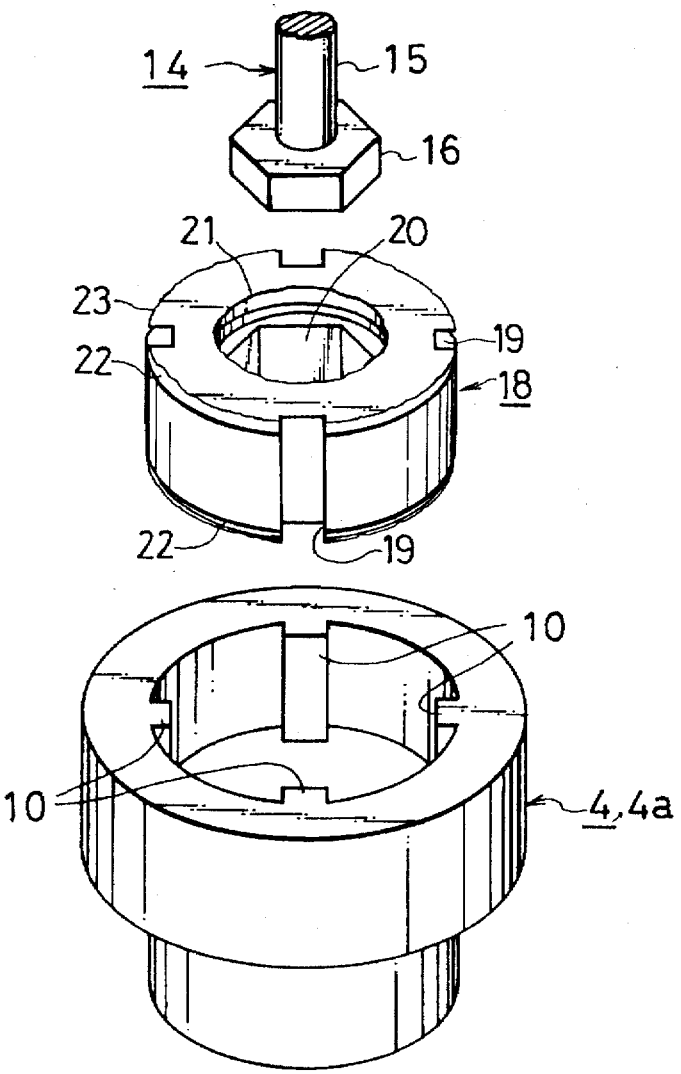
FIG. 2 is an exploded perspective view of the electrode of the present invention in which the conductive plate in FIG. 1 is contained.
Figure 3:
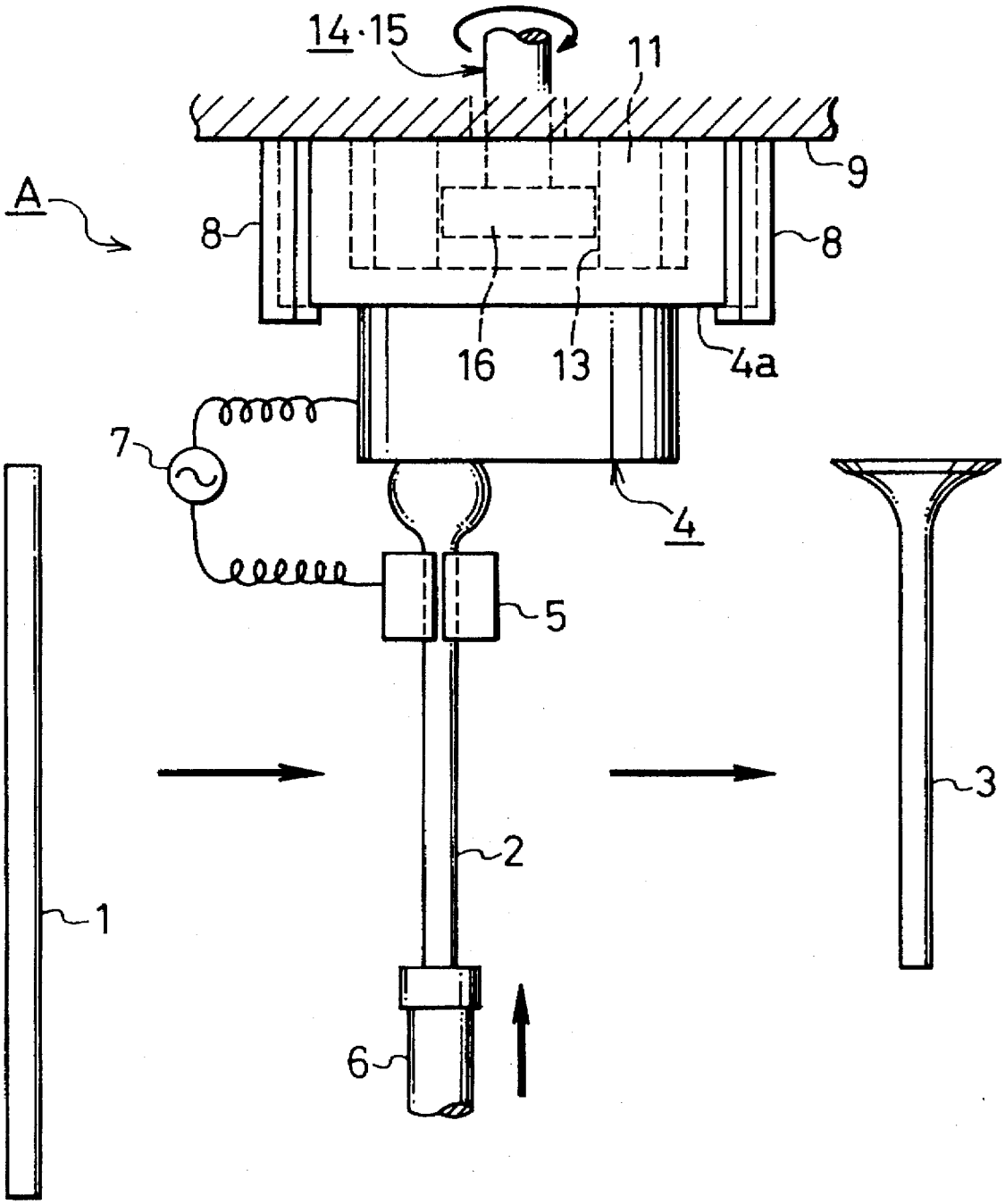
FIG. 3 PRIOR ART
FIG. 3 is a front elevational view of an electric gathering apparatus in which a workpiece is processed.
Figure 4:
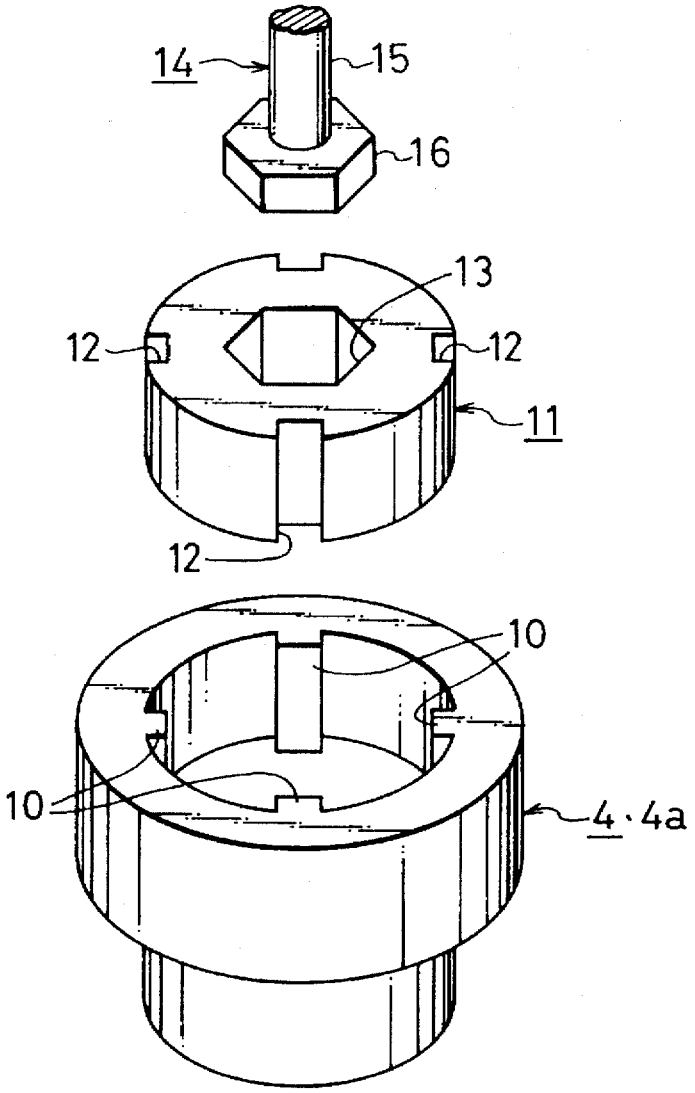
FIG. 4 PRIOR ART
FIG.4 is an exploded perspective view of a conventional electrode.
Figure 5:
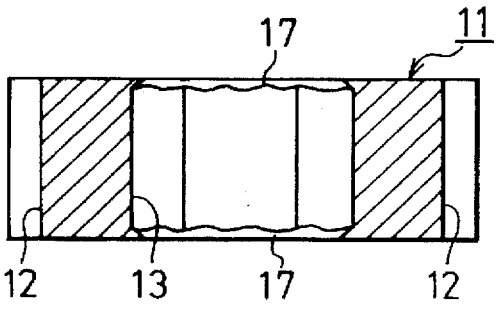
FIG. 5 PRIOR ART
FIG. 5 is a central longitudinal front view of a conventional conductive plate.

FIG. 2 is an exploded perspective view of the electrode of the present invention in which the conductive plate in FIG. 1 is contained.

The foregoings merely relate to an embodiment of the present invention. Various changes and modifications may be made by person skilled in the art without departing from the scope of claims wherein:

What is claimed is:

1. An electrode in an electric gathering for supplying current to a workpiece which is held between upper and lower electrodes to press the workpiece towards the upper electrode to expand an upper end of the workpiece, the upper electrode comprising a rotary electrode on which the upper end of the workpiece is engaged, and a conductive plate which is engaged in a bottom-having bore on the rotary electrode releasably and unrotatably, the conductive plate having a polygonal engagement bore in which a drive shaft is fitted around its axis, an annular cut-away portion which is larger than the engagement bore in diameter being formed at an upper edge of the engagement bore.

2. An electrode as defined in claim 1 wherein another annular cut-away portion which is larger than the engagement bore in diameter is formed at a lower edge of the engagement bore.

* * * * *